US005325774A

United States Patent [19]

Breton et al.

[11] Patent Number: 5,325,774

[45] Date of Patent: Jul. 5, 1994

[54] RIBBON PATH INDICATOR SYSTEM

[75] Inventors: Richard E. Breton, Rochester, N.H.; Gilles L. Fecteau, Saco, Me.; Joel C. Hern, Rollingsford, N.H.

[73] Assignee: Heidelberger Druckmaschinen AG, Heidelberg, Fed. Rep. of Germany

[21] Appl. No.: 11,035

[22] Filed: Jan. 29, 1993

[51] Int. Cl.[5] ..... B41J 15/00

[52] U.S. Cl. ..... 101/228; 400/247; 400/619; 226/100; 226/108

[58] Field of Search ..... 101/178–181, 101/228, 232; 400/247, 248.1, 619; 226/100, 108, 110

[56] References Cited

U.S. PATENT DOCUMENTS

| | | | |
|---|---|---|---|
| 4,267,554 | 5/1981 | Loepfe | 226/100 |
| 4,531,828 | 7/1985 | Hoshino | 101/181 |
| 4,848,634 | 7/1989 | Crowley | 226/108 |
| 5,252,838 | 10/1993 | Timblin | 101/181 |

*Primary Examiner*—David A. Wiecking
*Assistant Examiner*—Steven S. Kelley
*Attorney, Agent, or Firm*—Kenyon & Kenyon

[57] ABSTRACT

A system is provided for assisting operators of a printing press in webbing ribbons of a web material exiting a printing unit of the printing press through paths of rolls which direct the ribbons into preselected formers of a folder. A remote display device is provided on each roll which is utilized in more than one path. The remote display devices operate under the control of a web management system and display information which indicates the identity of its respective roll, the direction in which the ribbon must be wrapped around its respective roll, and the identity of the next roll to be wrapped. Ribbon path information for a plurality of jobs is stored by the web management system allowing for rapid ribbon path changes between jobs without limiting the number of permissible ribbon path layouts.

11 Claims, 5 Drawing Sheets

RIBBON PATH INDICATOR SYSTEM

FIELD OF THE INVENTION

The present invention relates generally to webbing ribbons of a web material exiting a printing unit of a printing press at makeready and re-start, and more particularly to a ribbon path indicator system which assists operators in webbing ribbons through paths of rolls which direct the ribbons into designated formers of a folder.

BACKGROUND OF THE INVENTION

A printed web of material exiting a printing unit of a printing press is typically cut lengthwise into a number of ribbons which are in turn directed into formers of a folder for folding and further processing. Since a single printing press may be used to produce many different publications, the path that a ribbon follows en-route to a folder varies depending upon the job being produced. At makeready, an operator must initially web each ribbon through an assembly path of angle bars, compensators, idler rolls, interleave rolls, and lead rolls and then into a designated former in the folder. This process must be repeated to re-web the ribbons if a web-break occurs.

Typically operators refer to layout diagrams to determine which ribbon paths should be followed for each job so that each ribbon is directed into the correct former of the folder. Another known method involves placing color-coded indicators on the various rolls to indicate to the operators which paths to follow. However, these methods have several drawbacks.

For one, webbing the ribbons requires operators to use both hands. This makes referring to the diagrams during the webbing process difficult. As for the use of color-coded indicators, this method limits the number of layouts that can be utilized. The more ribbons utilized, the more difficult and complicated this task becomes. Further, the more frequent layout changes are made, the more likely that errors will be made and waste will occur, especially if the operators are unfamiliar with operating the particular press or are inexperienced.

The above deficiencies are inherent to the known embodiments. Limitation of the number of different layouts actually run on a press, without generating additional waste at makeready and re-start, is the norm.

OBJECTS AND SUMMARY OF THE INVENTION

An object of the present invention is to provide a ribbon path indicator system that guides operators during the webbing process from the entry point of the ribbons on the angle bar of the former compensator/angle bar, through the assembly of idler, interleave, and lead rolls, to designated formers in the folder.

Another object of the present invention is to provide a ribbon path indicator system that indicates to operators any and all ribbon paths that can be followed through the compensator/angle bar/rolls section of the printing press to the designated formers of the folder.

Another object of the present invention is to provide a ribbon path indicator system that simultaneously provides this information for all ribbons to be webbed to multiple operators at different locations in the compensator/angle bar/rolls section of the printing press, so that the task of webbing the ribbons can be coordinated between the operators as they hand ribbons off to one another as a necessary part of the operation.

A further object of the present invention is to provide a path ribbon indicator system that is as in-obtrusive as possible, yet easily visible, and that is not limited in the number of layouts which it can display, while at the same time displaying the minimum data necessary to carry out the operation.

The present invention provides a system for assisting an operator in webbing ribbons through paths of rolls which simultaneously displays ribbon path instructions to the operator to allow the operator to quickly determine the proper ribbon path for a selected job.

The present invention provides a ribbon path indicator system for assisting an operator in webbing ribbons of a web material exiting a printing unit of a printing press through paths of rolls. The system includes a plurality of rolls, each of which are associated with a remote display device. Each remote display device contains a directional display indicator and a next roll display indicator and displays ribbon path instructions to the operator. The ribbon path instructions include one of a clockwise or counterclockwise wrapping direction, and an identity of a next roll to be wrapped. The system also provides controlling means, coupled to each of the remote display devices, for issuing commands to each remote display device to display the ribbon path information.

The present invention further provides a method of operating the ribbon path indicator system including the steps of retrieving ribbon path information for a preselected job from a storage device; operating the controlling means to issue commands, based upon the retrieved ribbon path information, which instruct each remote display device to display a respective ribbon path instruction; receiving the commands in each remote display device; and operating each remote display device to display its respective ribbon path instruction.

The present invention provides a remote display device mounted inside each roll at which ribbon path decisions must be made. The remote display device indicates the identity of its associated roll, the direction in which the ribbon must be wrapped around the associated roll, and the identity of the next roll which must be wrapped. This information can be displayed, for example, by utilizing clockwise, counter-clockwise, and alphanumeric LEDs. The remote display devices are coupled to a controlling means which may comprise a web management system which includes a processor and a storage device containing ribbon path information for a plurality of print jobs. Through the use of the web management system, the displays of the remote display devices can be quickly and easily changed during makeready.

In one embodiment of the present invention, the web management system is coupled to a plant-wide computer network. This allows the ribbon path information to be created and stored at a remote location and later retrieved by the web management system for use. In addition, such a configuration gives the present invention the ability to store an extremely large amount of ribbon path information without significantly increasing the system's set-up time.

These and other objects, characteristics and advantages of the present invention will become apparent from the description and accompanying drawings that follow.

BRIEF DESCRIPTION OF THE DRAWINGS

FIG. 1(*b*) is a planar view showing two ribbons of a cut web material following separate roll paths into designated formers of a folder.

DETAILED DESCRIPTION

Figure 1A:
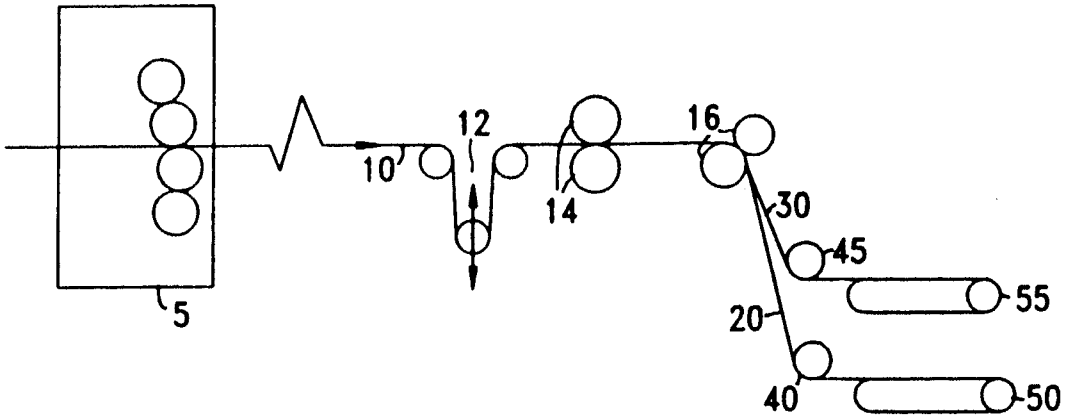
FIG. 1(a) (Prior Art)
FIG. 1(*a*) is a representational drawing showing a web exiting a printing press which is split into two ribbons and fed into angle bars.
Figure 1B:
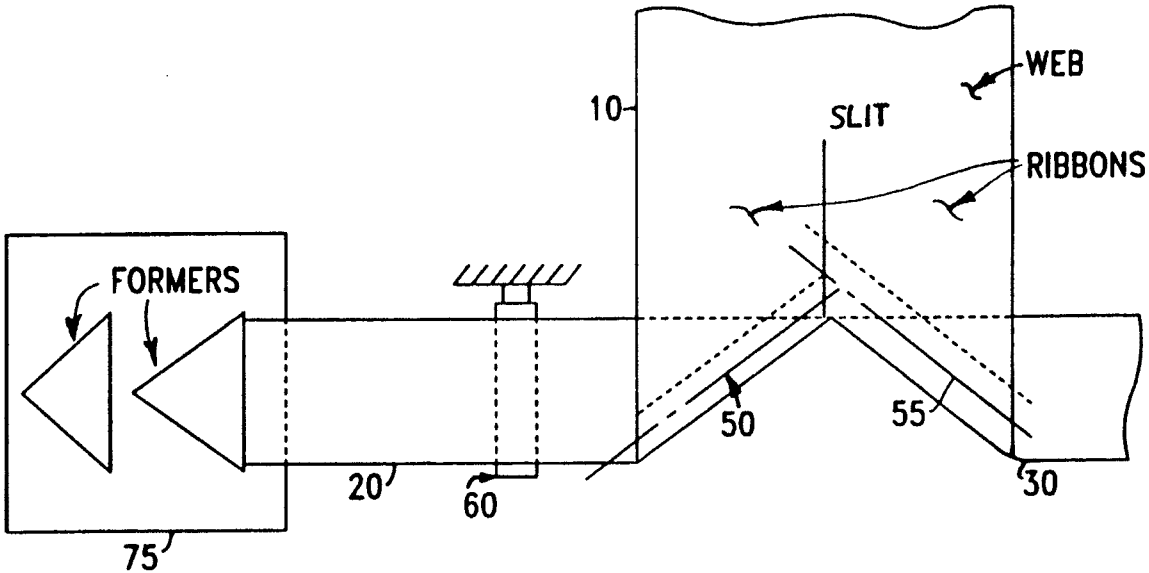
FIG. 1(b) (Prior Art)

FIGS. 1(*a*) & 1(*b*) show ribbons of a web material following separate roll paths into designated formers of a folder. Referring to FIG. 1(*a*), a web material 10 exits a printing unit 5, travels through a full web compensator 12 and is cut into ribbons 20 and 30 by a slitter 14 before entering a slitter pull roll 16. Although only two ribbons are shown, the web material 10 may be cut into any number of ribbons. An operator wraps the ribbons 20 and 30 around lead rolls 40, 45 to angle bars 50 and 55 respectively. The angle bars 50, 55 change the direction of the ribbons 20 and 30 by approximately 90 degrees as shown in FIG. 1(*b*). The operator then webs the ribbon 20 through a lead roll 60 into a designated former 75 of a folder (the path of ribbon 30 is not shown).

Figure 4:
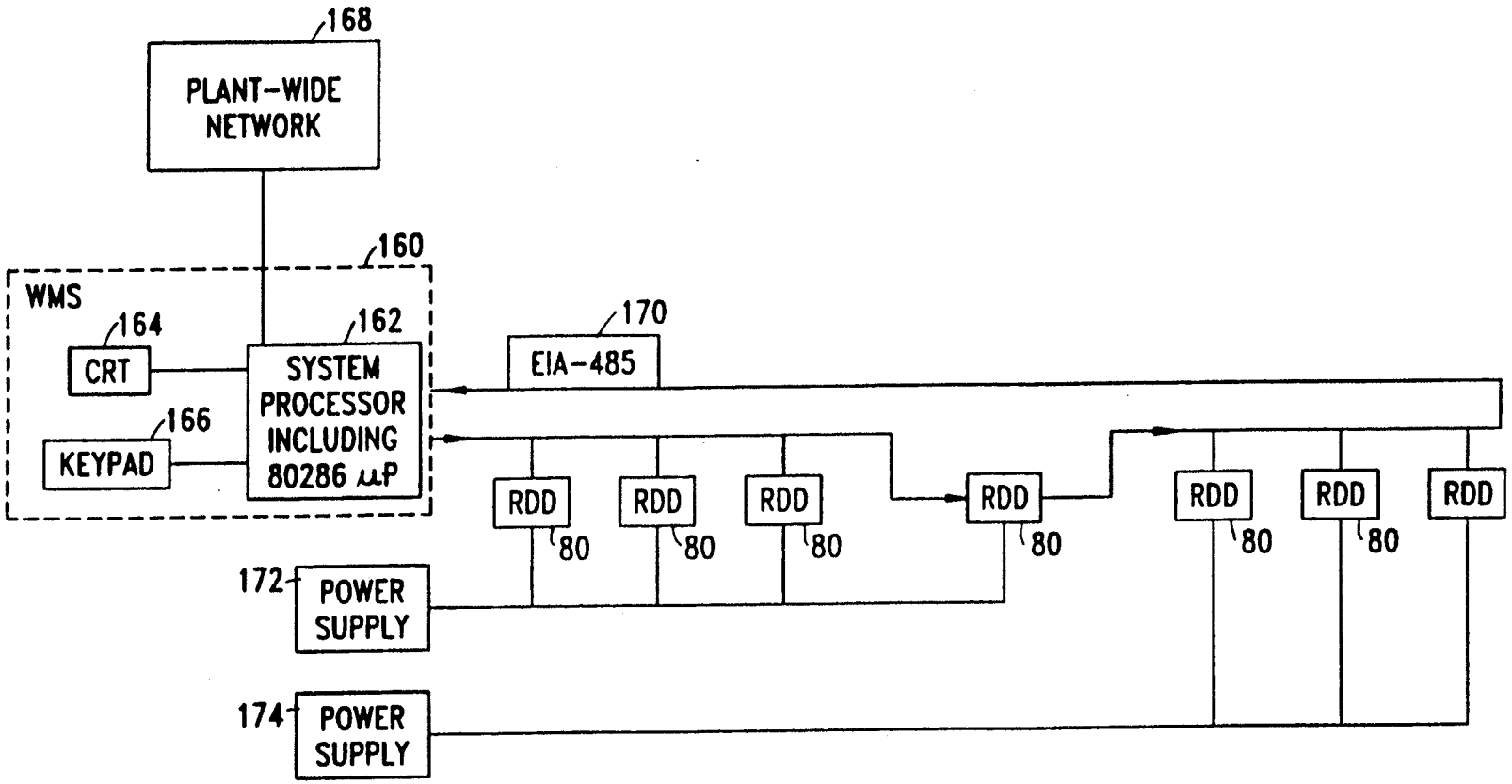
FIG. 4 is a schematic diagram of a ribbon path indicator system of the present invention showing a web management system connected to a plurality of remote display devices.

To assist the operators in choosing ribbon paths that will direct the ribbons into the correct formers, the present invention provides a ribbon path indicator system having a plurality of remote display devices 80 ("RDDs"). as shown in FIG. 4. The RDDs 80 are mounted inside each roll where ribbon wrap and path decisions must be made. Alternatively, the RDDs 80 could be suitably mounted in close proximity to a respective roll at which ribbon path decisions must be made. The RDD 80 must, however, be mounted in such a manner that the roll to which it relates is unambiguously identified to the operator.

Figure 2:
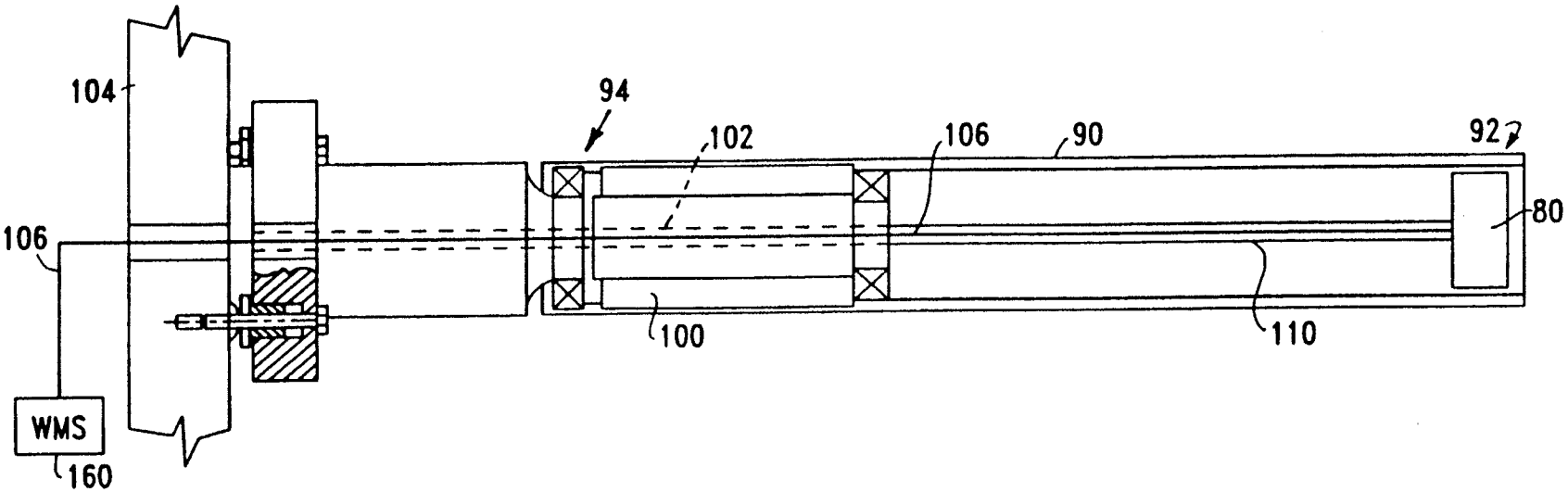
FIG. 2 is a cross-sectional top view of a roll incorporating a remote display device of the present invention.

FIG. 2 shows a roll 90, e.g., an interleave roll or lead roll, having a front end 92 and a rear end 94. The rear end 94 of the roll 90 is mounted on a roll shaft 100, having a bore 102 extending axially through its center. The shaft 100 is itself mounted to a frame 104 of the printing press. A RDD 80 is mounted within the front end 92 of the roll 90. The RDD 80 is connected to a web management system (WMS) 160 electronically by a communication cable 106 which passes through a bore 110, axially disposed within the roll 90, and the bore 102 in the shaft 100 to the WMS 160.

The RDDs 80 each include a plurality of LED displays which indicate: (1) the identity of the corresponding roll if that roll is to be used (the RDD identifier); (2) the direction (clockwise or counter-clockwise) in which the ribbon must be wrapped around the roll; and (3) the identity of the next roll which must be wrapped (the Next RDD).

Figure 3:
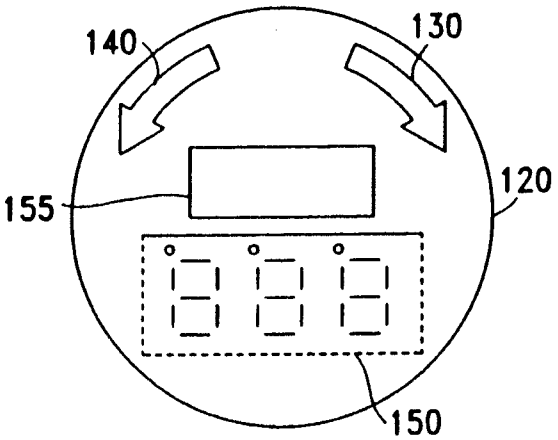
FIG. 3 is a front view of a display panel of the remote display device of the present invention.

Referring to FIG. 3, a display panel 120 of a RDD 80 is shown which includes a clockwise LED 130, a counter-clockwise LED 140, and three 7 segment LEDs 150. The directional LEDs 130, 140 are used to indicate the direction in which the ribbon must be wrapped. The number of the roll (the RDD identifier) is dimly illuminated in the three 7 segment LEDs 150 to indicate its identity if that roll is to be used. The LEDs 150 are also utilized to indicate, with brighter illumination, the number of the next roll to be wrapped (the Next RDD). The RDD identifier and the Next RDD are alternately displayed (e.g., alternating every 5 seconds) by the RDD 80. The brightness of each display can be individually set by altering the duty cycle of the LED as is well known in the art.

In an alternative embodiment of the present invention, the RDD identifier is provided on a label 155 affixed to the face of the RDD as shown in FIG. 3. In this embodiment, the three 7 segment LEDs 150 are used only to display the Next RDD and diagnostic information.

It should be understood that icons, or any other symbols may be substituted in lieu of the identification numbers. It should also be understood that the display panel 120 is capable of adapting to different roll numbering conventions, if necessary.

The RDDs 80 are coupled to the WMS 160 via a serial bus 170 which complies with the EIA-485 standard, as shown in FIG. 4. The RDDs 80 are supplied by power supplies 172 and 174. The WMS 160 can be comprised of any conventional computer capable of performing the functions described herein.

In an illustrative embodiment of the present invention, the WMS 160 is comprised of a system processor 162 which includes, for example, an Intel 80286 microprocessor; a CRT 164; and a keypad 166. At make-ready, the WMS 160 retrieves ribbon path information either from a local storage device, e.g., a hard disk, or from a remote storage device in a plant-wide network 168, and uses the retrieved data to transmit commands to the RDD 80's which instruct the RDD 80's to display the appropriate RDD identifier, directional display, Next RDD and diagnostic displays. New ribbon path information can be entered via the CRT 164 and keypad 166 and stored either on the local hard disk or in a remote location via the plant-wide network 168. Naturally, the ribbon path information can also be entered from remote terminals which are connected to the WMS 160 via the plant-wide network 168. The above-described configuration has the advantage of allowing ribbon path information for a plurality of jobs to be stored and later retrieved for repeated use.

Figure 5:
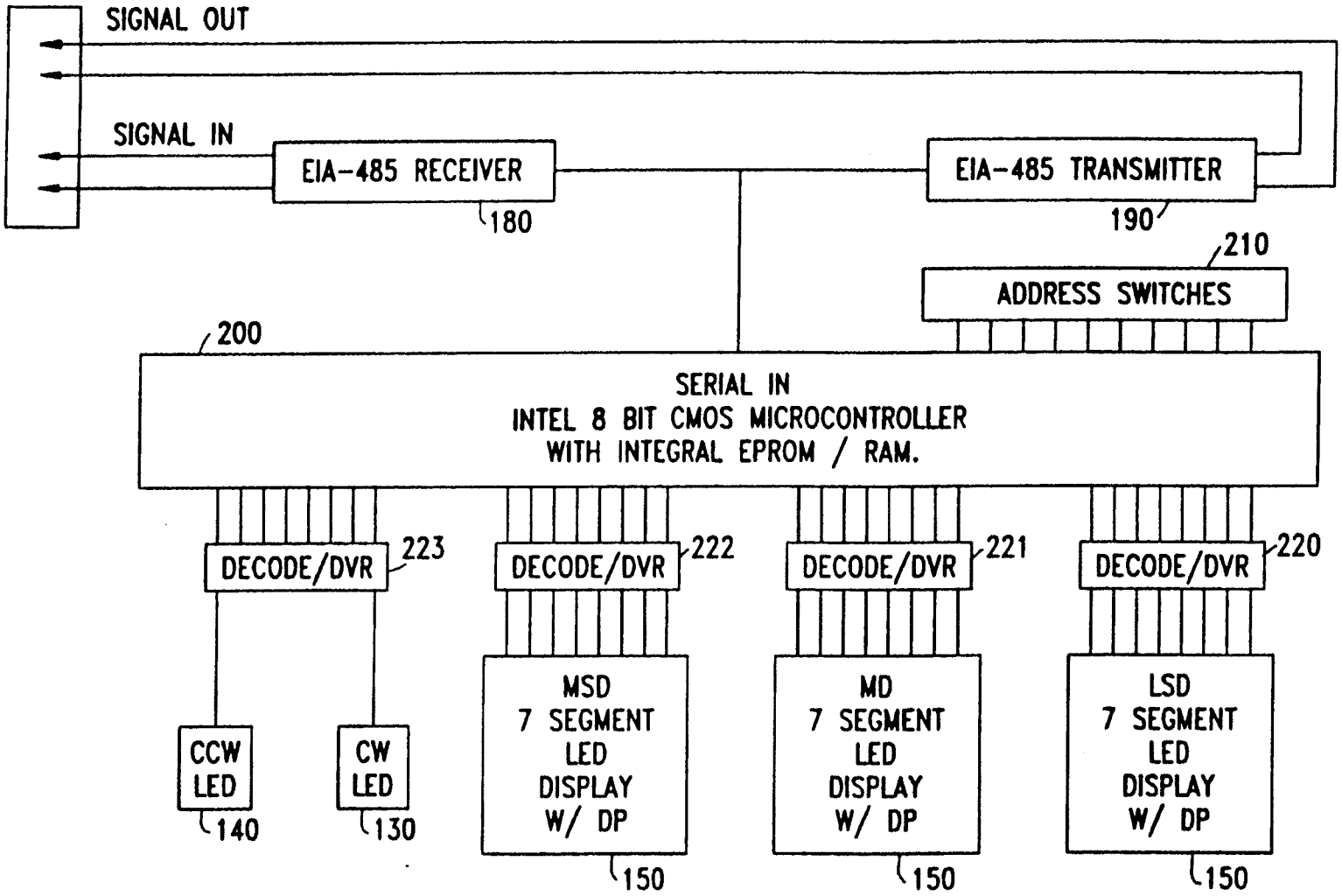
FIG. 5 is a schematic diagram of the preferred embodiment of a circuit of the remote display device of the present invention.

Referring now to FIG. 5, each RDD 80 includes an EIA-485 receiver 180, an EIA-485 transmitter 190, an 8 bit microcontroller 200, an address identifier switch 210, a clockwise LED 130, a counter-clockwise LED 140, and three 7 segment LED displays 150. The WMS 160 transmits commands on the bus 170 which direct each RDD 80 to display the proper RDD identifier, directional display and Next RDD. The WMS 160 also transmits set-up information such as the brightness of the respective displays, and the rate at which the RDD identifier and Next RDD will be alternated.

The commands are received in the EIA-485 receiver 180 of each RDD 80 and applied to the serial input of the microcontroller 200. Each RDD 80 has a distinct address which is determined by the address identifier switch 210 (coupled to the microcontroller 200) and which allows the microcontroller 200 to disregard commands which are intended for other RDDs. The microcontroller 200 has outputs coupled to each of 4 LED decoder/drivers 220–223. Drivers 220–222 are each coupled to a respective one of the 7 segment LEDs 150. Driver 223 is coupled to the directional LEDs 130, 140. The microcontroller 200 processes the commands which it determines are intended for its respective RDD in accordance with a set of instructions contained in the RAM or EPROM which is resident on the microcontroller 200. In this manner the microcontroller 200 controls the LED displays 130, 140, 150 via the drivers 220–223 to display the RDD identifier, Next RDD, and directional display as instructed.

The microcontroller 200 also conducts a continuous checksum test to detect errors in the received data stream. Upon detection of an error, an appropriate message is displayed on the 7 segment LEDs 150. The microcontroller 200 can also be programmed to perform other diagnostic functions, such as indicating a bus timeout on an LED display if no activity is detected on the bus 170 for, e.g., 60 seconds. Moreover, as shown in FIG. 5, an EIA-485 transmitter can be provided on each RDD 80 so that any RDD 80 can function as a signal booster by simply connecting it in series to the bus 170.

While the present invention is capable of various modifications and alternate constructions, it is not intended to limit the invention to the specific embodiments disclosed herein. Rather, it is intended to cover all modifications and alternative constructions falling within the spirit and scope of the invention as expressed in the claims.

What is claimed is:

1. A ribbon path indicator system for assisting an operator in webbing ribbons of a web material exiting a printing unit of a printing press through paths of roll, comprising:

(a) a plurality of rolls, each roll having an associated remote display device;

(b) each associated remote display device including a directional display indicator and a next roll display indicator, the remote display device displaying ribbon path instructions to the operator including one of a clockwise or counterclockwise wrapping direction, and an identity of a next roll to be wrapped; and (c) controlling means coupled to each of the remote display devices, the controlling means issuing commands to each remote display device to display a preselected one of the clockwise or counterclockwise wrapping direction, and a preselected next roll to be wrapped.

2. The ribbon path indicator system as recited in claim 1, wherein the controlling means is a web management system which includes a processor coupled to a storage means, the storage means storing a plurality of files, each of the files containing ribbon path information for a selected print job, the processor operating to selectively retrieve a preselected one of the files and utilize the ribbon path information to instruct each remote display device to display preselected ribbon path instructions to the operator.

3. The ribbon path indicator system as recited in claim 2, wherein each roll has a rear end and a front end, the rear end mounted to a frame of the printing press, the remote display device mounted to the front end such that the display indicators of the remote display device are visible to the operator.

4. The ribbon path indicator system as recited in claim 3, wherein each roll has a bore axially disposed therein, each remote display device having a cable coupled to the controlling means through the bore in its respective roll.

5. The ribbon path indicator system as recited in claim 1, wherein each of the remote display devices displays ribbon path instructions substantially simultaneously.

6. The ribbon path indicator system as recited in claim 1, wherein the next roll display indicator of each remote display device also displays a roll identifier which identifies the roll to which each remote display device is associated; and the controlling means issues commands to each remote display device to display the roll identifier for a respective roll.

7. The ribbon path indicator system as recited in claim 6, wherein the next roll display indicator of each remote display device alternately displays the roll identifier and the identity of the next roll to be wrapped.

8. The ribbon path indicator system as recited in claim 7, wherein each remote display device further includes:

(a) a receiver for receiving commands from the controlling means;

(b) a microcontroller having an input coupled to the receiver for processing the commands received from the controlling means;

(c) the microcontroller having outputs coupled to each of a clockwise LED, a counter-clockwise LED, and an alphanumeric LED; and (d) wherein the microcontroller operates to process the commands received from the controlling means, and to control the clockwise LED, the counter-clockwise LED, and the alphanumeric LED to display the ribbon path information for its respective roll.

9. In a system including controlling means coupled to a plurality of remote display devices, each of the remote display devices associated with and situated relative to a roll at which ribbon path decisions must be made, the controlling means including a storage device which contains ribbon path information for a plurality of jobs, a method for assisting an operator in webbing ribbons of a web material exiting a printing unit of a printing press through paths of rolls, comprising the steps of:

(a) retrieving ribbon path information for a preselected job from the storage device;

(b) operating the controlling means to issue commands, based upon the retrieved ribbon path information, which instruct each remote display device to display a respective ribbon path instruction;

(c) receiving the commands in each remote display device; and (d) operating each remote display device to display its respective ribbon path instruction, the respective ribbon path instruction including one of a clockwise or counterclockwise wrapping direction, and an identity of a next roll to be wrapped.

10. The method as recited in claim 9, wherein the operating each remote display device step further includes operating each remote display device to alternatively display a roll identifier, which identifies its associated roll, with the identity of the next roll to be wrapped.

11. The method as recited in claim 10, wherein the operating each remote display device step further comprises operating each remote display device to display its respective ribbon path instruction substantially simultaneously.

* * * * *